US006953233B2

(12) United States Patent
Lam et al.

(10) Patent No.: US 6,953,233 B2
(45) Date of Patent: Oct. 11, 2005

(54) CLOSING DEVICE FOR DRAWERS

(76) Inventors: Harn Lian Lam, 7, Jalan Au Kong, Taman Kampar, 30250 Ipoh (MY); Harn Yan Lam, 7, Jalan Au Kong, Taman Kampar, 30250 Ipoh (MY)

( * ) Notice: Subject to any disclaimer, the term of this patent is extended or adjusted under 35 U.S.C. 154(b) by 0 days.

(21) Appl. No.: 10/440,415

(22) Filed: May 19, 2003

(65) Prior Publication Data

US 2004/0000850 A1 Jan. 1, 2004

(30) Foreign Application Priority Data

May 17, 2002 (MY) ..... PI 2002 1815

(51) Int. Cl.[7] ..... A47B 88/04
(52) U.S. Cl. ..... 312/333; 312/319.1
(58) Field of Search ..... 312/330.1, 333, 312/334.1, 334.6, 334.44, 319.1, 319.2

(56) References Cited

U.S. PATENT DOCUMENTS 5,207,781 A 5/1993 Rock
5,364,179 A * 11/1994 Brustle et al. ..... 312/333
5,474,375 A * 12/1995 Hollenstein et al. ..... 312/319.1

FOREIGN PATENT DOCUMENTS

DE 2421657 * 11/1975
EP 0 391 221 3/1990
EP 0 927 530 11/1998
GB 1117071 6/1968
WO WO 92/00027 1/1992

OTHER PUBLICATIONS

U.S. Appl. No. 10/440,413, "Guide Rails for pull–out Drawer/Equipment," filed May 19, 2003.

* cited by examiner

*Primary Examiner*—James O. Hansen
(74) *Attorney, Agent, or Firm*—Volpe and Koenig, P.C.

(57) ABSTRACT

An improved closing device for opening and closing a slidable drawer is presented. The device entails an elongate hollow cylindrical housing having an axial slot extending from one end over at least a part of the body and second axial slot being 'L' shaped where the leg of the L is adjacent and substantially parallel to first slot. A cylindrical member is slidable in the body with the projection extending from the member inserted into a second slot. The cylindrical piece with angled groove is able to receive a pin attached to the guide rail of the drawer so that when the draw is opened the pin pulls the cylindrical piece along the first slot towards the angled section. The cylindrical piece rotates and locks due to the extension on second slot. Furthermore, when the drawer is closed the pin on the guide rail, when pushed in, engages with the first slot that rotates the cylindrical piece thus releasing the extension and the spring pulls the drawer to a closed position.

2 Claims, 7 Drawing Sheets

CLOSING DEVICE FOR DRAWERS

FIELD OF INVENTION

The present invention relates to a closing device, more particularly one that is durable and provides better means for opening and closing a slidable drawer.

BACKGROUND OF THE INVENTION

Most drawers used presently are provided with a pull-out guide assemblies on each of opposite sides of the drawer. Each such pull-out guide assembly includes a supporting rail on the furniture body and a pull out rail on the drawer. The pull-out guide assemblies are designed to ensure that the movement of the drawer into and out of the furniture body will be easy and as smooth as possible.

Conventionally rollers, balls or slides are provided for transmitting the load of the drawer from the pull-out rails to the supporting rails of the furniture body. Such arrangements are adapted to the requirements of a particular drawer with respect to smoothness of operation and loading capacity.

It has been found that a drawer that has been moved to a closed position sometimes will not be in its fully closed rear end position, i.e. fully inserted into the furniture body, such that a front plate or an end of drawer projects from the furniture body. As a result it is possible for persons to bump against the front of the drawer or injury of such persons may occur. Projection of the front plate of the drawer from the front of the furniture body may occur when the drawer has been pushed into the furniture body without care or not to the full extent. Also when the drawer has been pushed into the furniture body with too much energy, the drawer may again roll forwardly or rebound because of such excessive energy.

A closing device for a drawer is disclosed in GB-PS 1 117 071 wherein there is provided a tilting member or part which is movable between two end positions. The tilting member is acted upon by a coil spring and thereby is urged into respective end positions after having moved past a dead center position. The tilting member is fastened to a side wall of the furniture body, and the drawer is provided with the driving pin member which is inserted into a notch or slot in the tilting member during an end portion of the path of movement of the drawer. The driving pin member then movement of the drawer. The driving pin member then moves the tilting member past the dead center position, whereupon the tilting member itself pulls the driving pin member and thus the drawer toward the rear of the furniture body under the action of the coil spring.

In U.S. Pat. No. 5,207,781 is disclosed a closing device which can pull a drawer over a longer distance into an article of furniture. This closing device also employs a tilting member, but such tilting member not only tilts but travels on a guide track having a rectilinear rear portion. A similar device is shown in WO-Al-92/00027.

SUMMARY OF THE INVENTION

The present invention relates to a closing device for use in an article of furniture having furniture components including furniture body and a drawer slidable in opposite directions into and out of the furniture body, for moving the drawer to a fully inserted position within the furniture body, said closing device comprising: an elongate hollow cyclindrical housing having an axial slot extending from one end over at least a part of the body and second axial slot being 'L' shape where the leg of the L being adjacent and substantially parallel to first slot; a cyclindrical member slidable in the body with the projection extending from the member inserted into second slot; the cylindrical piece with angled groove to receive pin attached to the guide rail of the drawer; wherein when the draw is opened the pin pulls the cyclindricaln piece along the first slot towards the angled section, in effect the cyclindrical piece rotates and locks due to the extension on second slot; furthermore when said draw is closed the pin on guide rail when pushed in engages with the first slot which rotates the cylindrical piece thus releasing the extension and the spring pulls the drawer to a closed position.

DETAILED DESCRIPTION OF THE DRAWINGS

Figure 1:
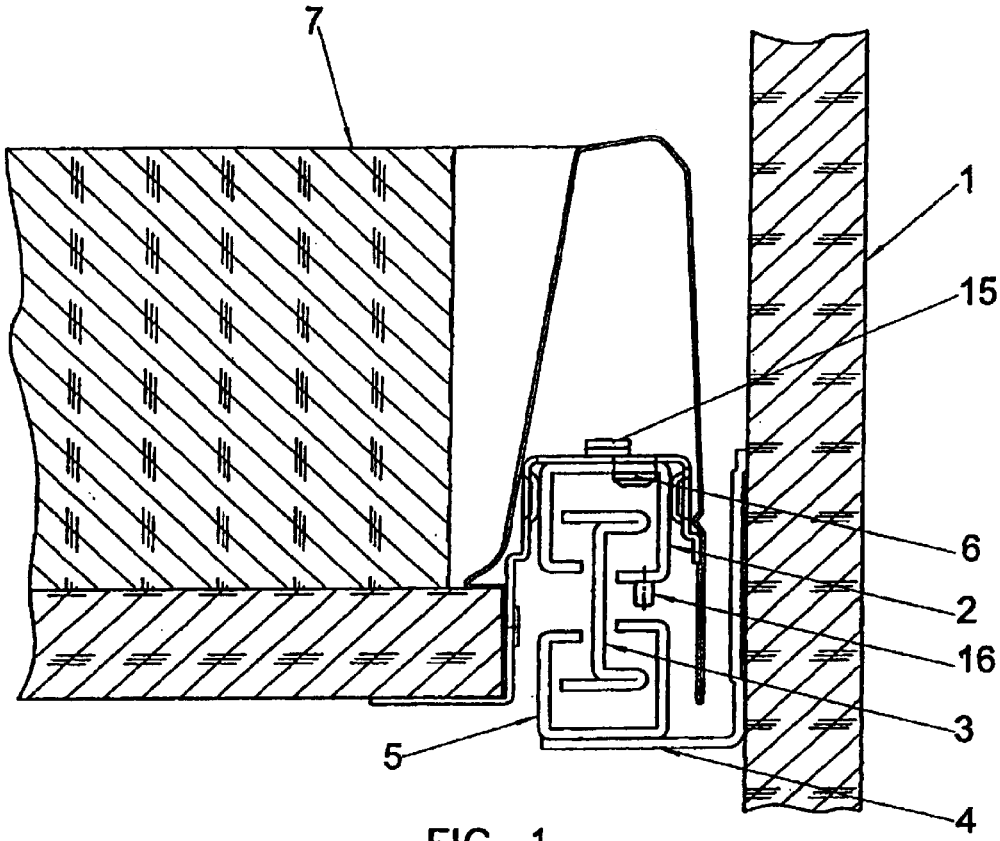
FIG-1 PRIOR ART
FIG. 1 is a partial front view of a drawer without front panel. Shown with side wall of furniture body and drawer slide.
Figure 2:
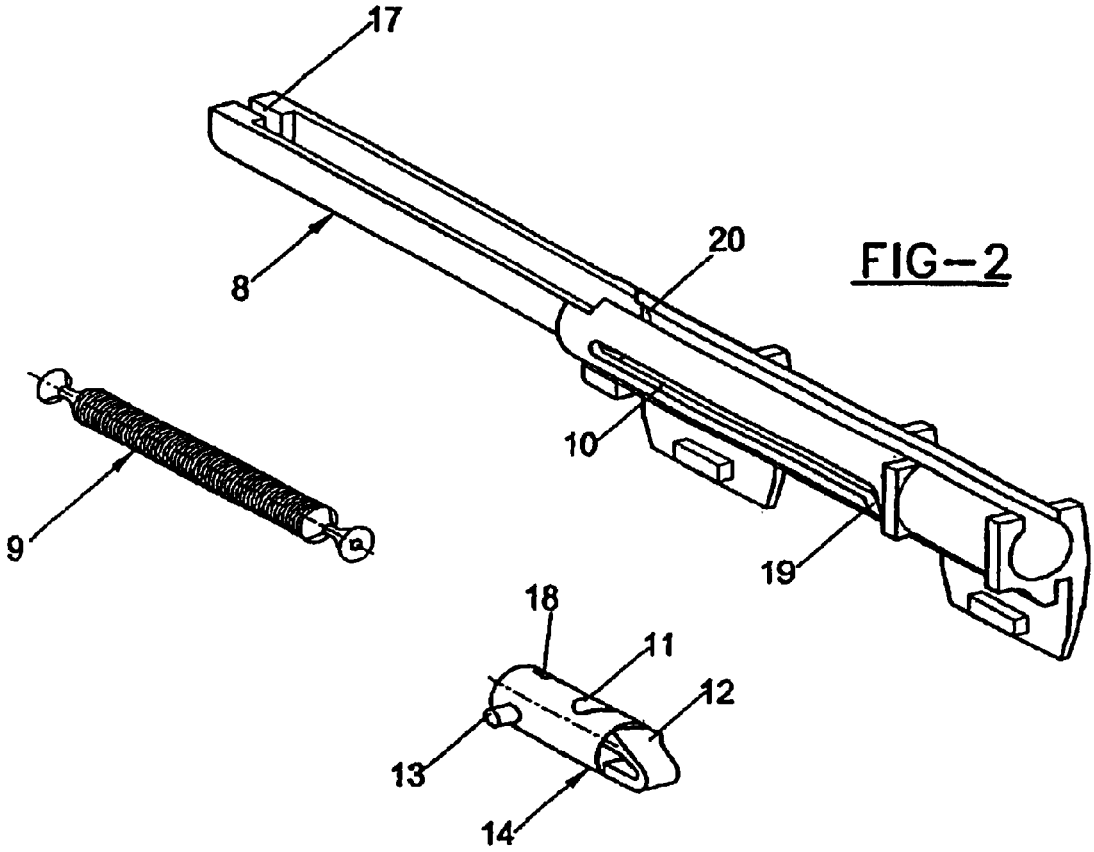
FIG. 2 is a perspective exploded view of parts of the device.

FIG. 1 shows a typical drawer assembly with a guide rail. FIG. 2 shows the present invention which is a closing device for the purpose of shutting the drawer in a fully inserted position within the cabinet or furniture body. The device comprise an elongate hollow cyclindrical housing having an axial slot extending from one end over at least a part of the body and second axial slot being 'L' shape where the leg of the L being adjacent and substantially parallel to first slot. There is provided a cyclindrical member slidable in the body with the projection extending from the member inserted into second slot. The cylindrical piece has an angled groove to receive pin attached to the guide rail of the drawer.

Figure 3:
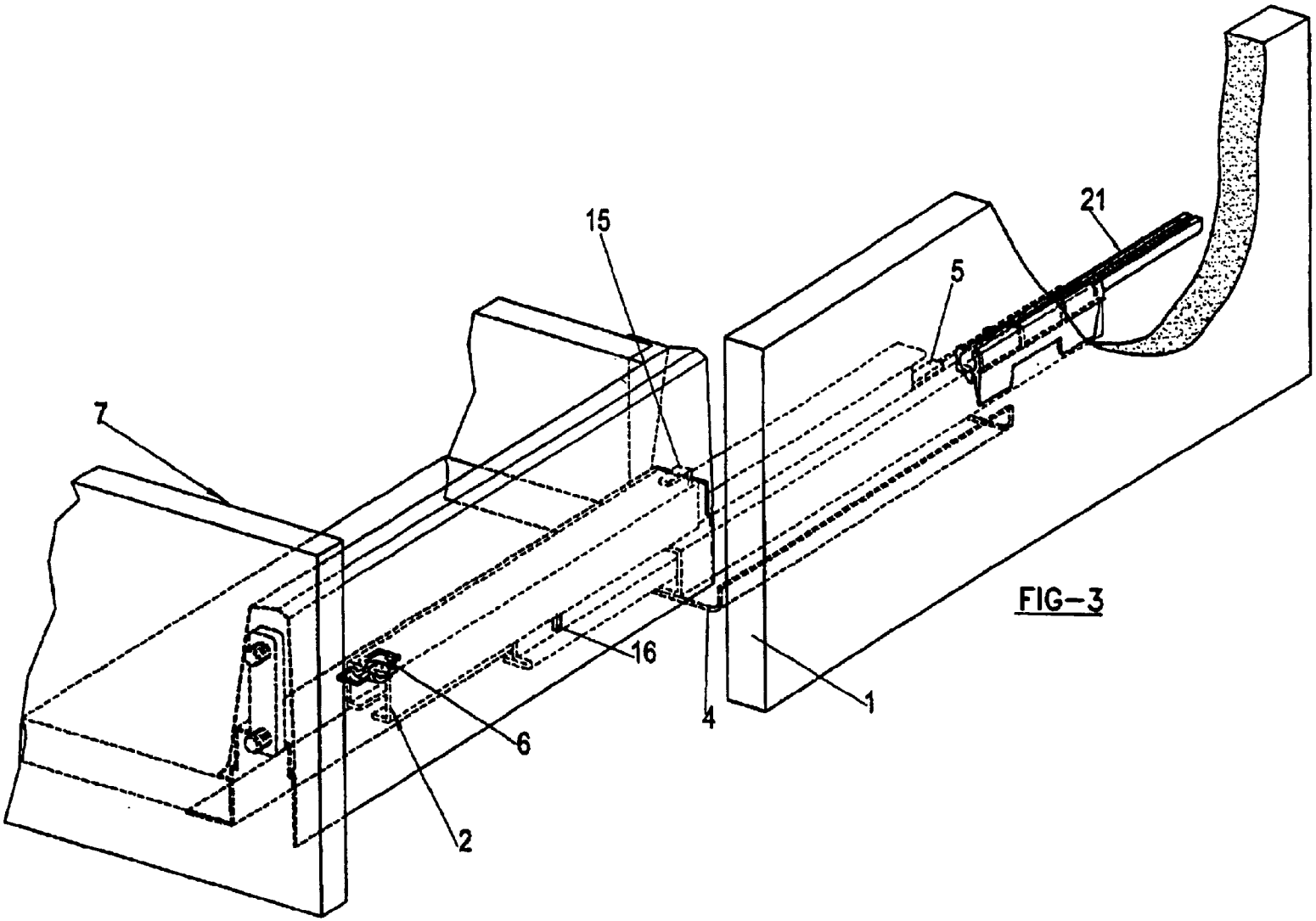
FIG. 3 is a partial perspective view of a drawer assembly with the guiding body of closing device attached to the bottom roller guide.

FIG. 3 illustrates the manner in which the invention is attached to the guide rail of the drawer. A pull out rail is mounted underneath a bottom plate of a drawer and next to a drawer side wall. On its rear end the pullout rail is provided with a hook which protrudes into a hole in the rear wall of the drawer. Pull out guide assembly featuring rollers mounted in separate roller carriers provides very smooth running features. At the rear of the pullout rail is provided a pin member. Said pin member is basically a cylindrical extension. The housing of the closing device is mounted on the rear end of the supporting rail.

When the drawer is in the fully inserted position, the pin member is engaged within the groove and in the first slot. When the drawer pulled out, the pin pulls the cylindrical member while extending the spring attached to the cylindrical member. The first slot acts as a guide track for the pin member when pulled.

The device includes a pin member attached to the drawer and a rotating member attached to the furniture body. This rotating member is movable in opposite directions inside a guiding body. This pin member will be engaged in a slot inside the rotating member when the drawer is in fully inserted position. Rotating member is connected to the body by a spring. A projection on the rotating member will be guiding slot and regulates the rotation when the pin member engages in the rotating member. One end of the guiding slot acts as a locking portion for the rotating member. Spring acts inwardly on the rotating member when the drawer is pulled out. When the drawer along with the pin member is pulled the rotating member moves in the same direction of the drawer. A projection on the rotating member will be guided inside the guiding body. This projection makes the rotating member to rotate about its center axis at a certain point and gets locked on the guiding slot. This prevents the rotating member from retracting to the original position by the spring force and also pin member gets disengaged from rotating member. The width of the slot in the rotating member is bigger than the width of pin member. This device makes a positive closing of drawer without projection the drawer out of furniture body.

Figure 4:
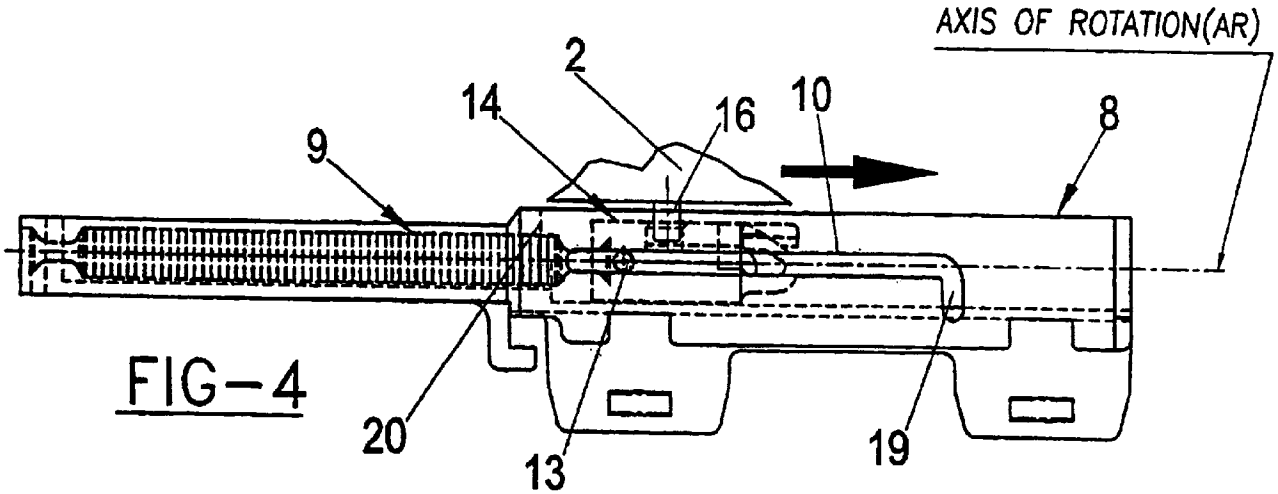
FIG. 4 is a side view of the device with rotating member engaged with pin member from the drawer side.

As shown in the figure drawer assembly (7) is attached to the top roller guide (2) with a back stopper (15) and a front clip (6). Back stopper (15) prevents the drawer from lifting up and also acts as an end stop and front clip (6) prevents the drawer from coming out of the top roller guide (2). The runner system consists of intermediate roller guide (3), bottom roller guide (5) and angular support (4). Intermediate roller guide (3) travels relatively in between the top roller guide (2) and bottom roller guide (5). Roller housings with rollers are placed between (not shown in fig.). These rollers imparts a smooth running of the drawers. A guiding body (8) is attached to the rear end of bottom roller guide (5) (ref. FIG. 3). This guiding body (8) is provided with a guiding slot (10). A rotating member (14) which is having a slot (11) and a projection (13) an also a flap (12) (ref. FIG. 2). Rotating member (14) will be placed inside the guiding body (8) and it is moveable freely inside the guiding body (8). The projection (13) on the rotating member (14) will be sliding inside the guiding slot (10) of the guiding body (8). Rotating member (14) is attached to the guiding body (8) by a spring (9) (ref. FIG. 4). The guiding slot (10) of the guiding body (8) regulates the rotation of the rotating member (14) when pulled out.

Figure 5:
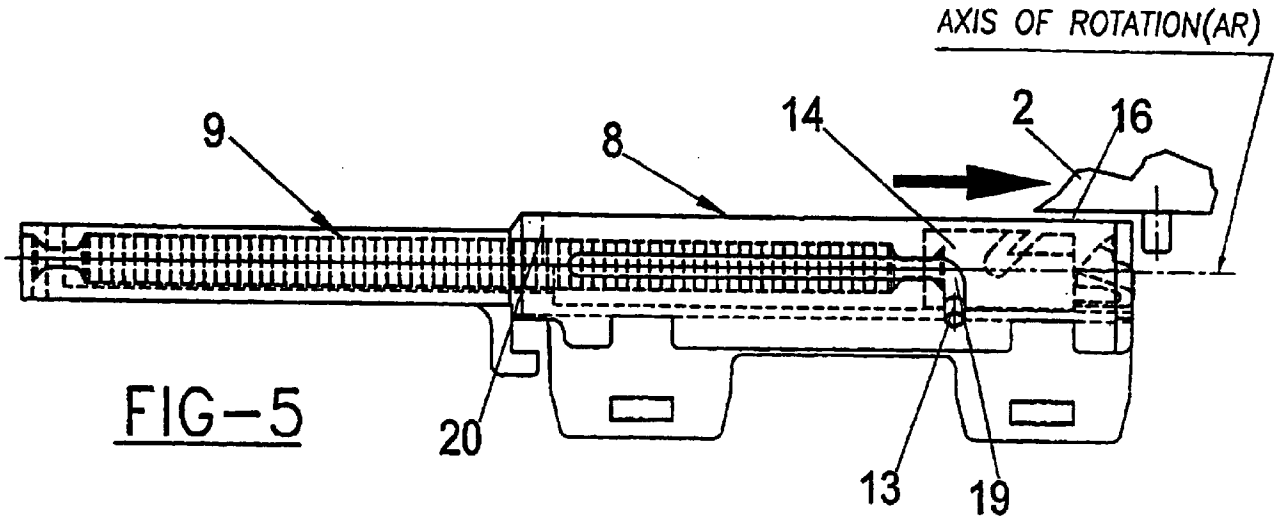
FIG. 5 is a side view of the device with rotating member gets rotated about its axis and pin member releases from rotating member.
Figure 7:
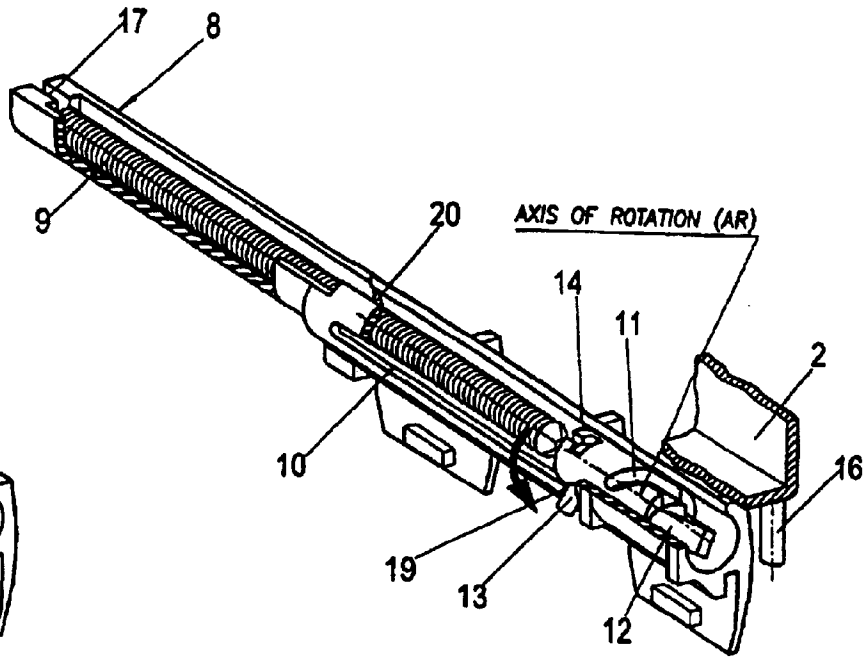
FIG. 7 is a perspective view of the device with rotating member rotates about its axis to a locking position on the guiding slot with the projection on the rotating member guiding on the guiding slot.
Figure 6:
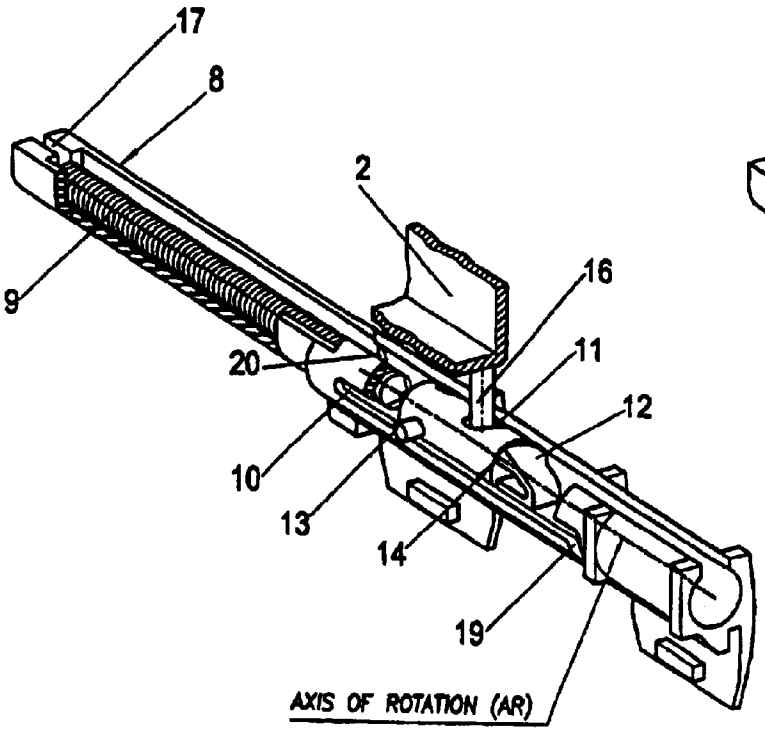
FIG. 6 is a perspective view of the device with rotating member at its initial position with the pin member engaged when the drawer is fully inserted position.
Figure 8:
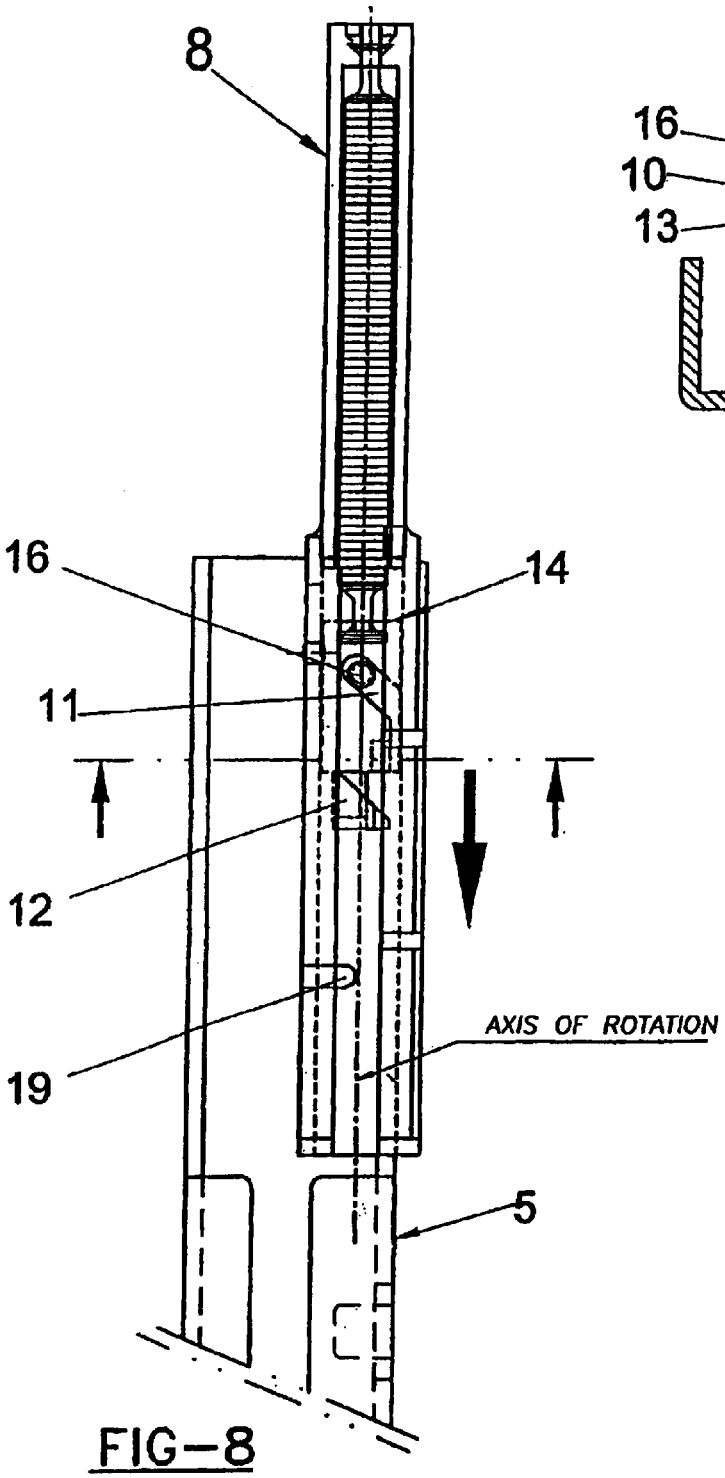
FIG. 8 is a top view of the device with rotating member engaged with pin member from the drawer side.
Figure 9:
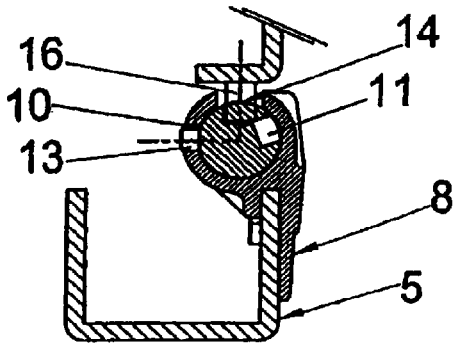
FIG. 9 is a cross sectional view of the device with rotating member engaged with pin member from the drawer side.
Figure 10:
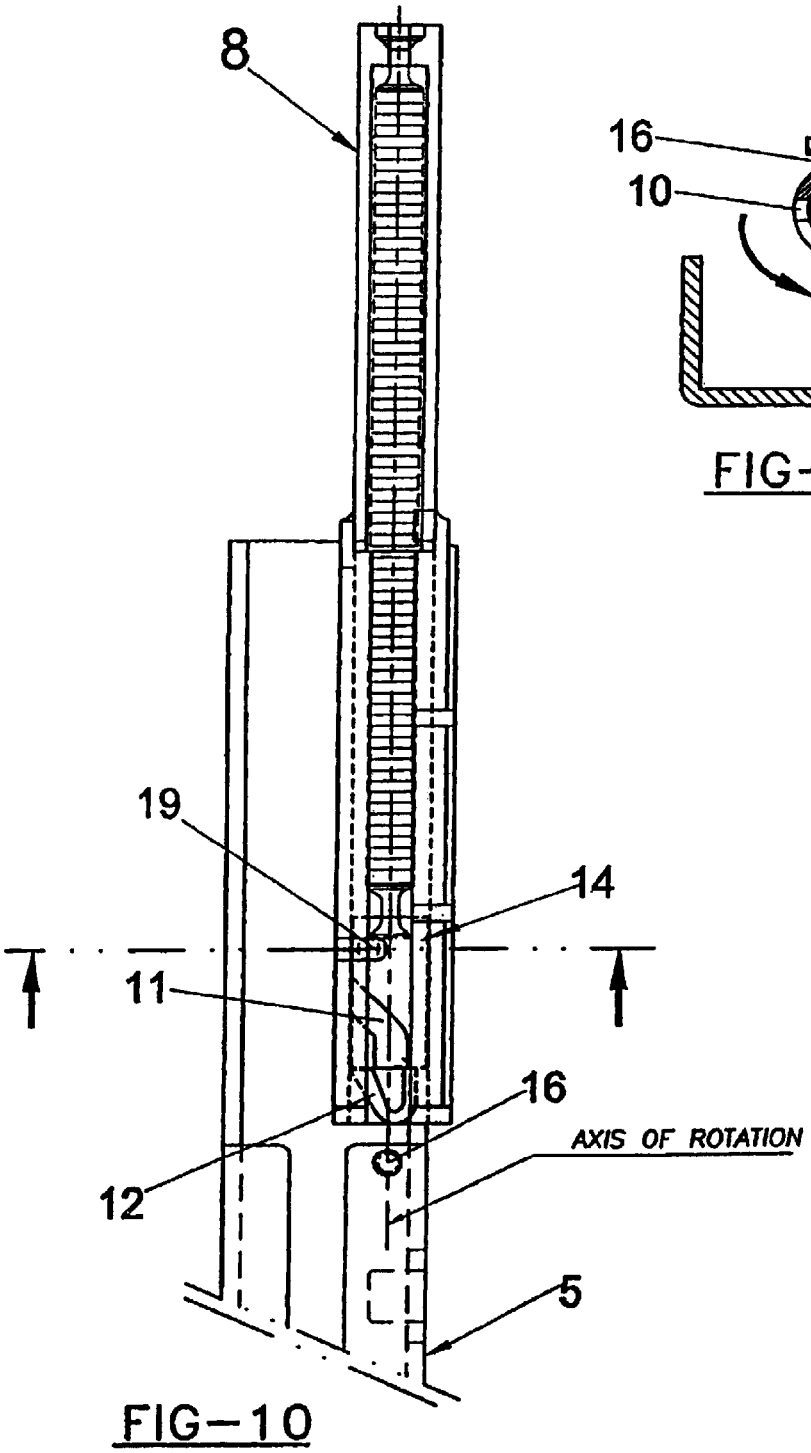
FIG. 10 is a top view of the device with rotating member gets rotated about its axis and pin member releases from member.
Figure 11:
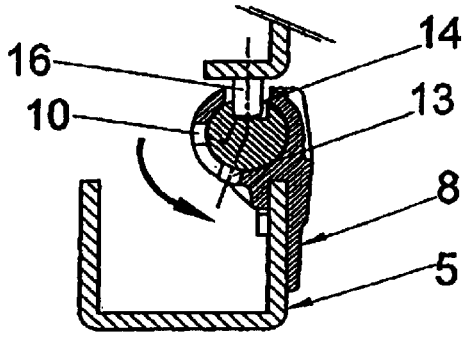
FIG. 11 is a cross sectional view of the device with rotating member gets rotated about its axis and pin member release from rotating member.

Spring (9) is attached to the rear edge (17) of the guiding body (8) and rear slot (18) of the rotating member (14). The spring (9) will be pulling the rotating member (14) towards the rear edge (16). When the drawer (7) is in fully inserted position the rotating member (14) will be resting at the rear end of the guiding slot (10) (ref. FIG. 4) and pin member (16) rests inside the slot (11) of the rotating member (14). When the drawer is pulled out of the furniture body (1) the rotating member (14) is moved along with the pin member (16) in the direction of the arrow (ref. FIG. 4), FIG. 7 and FIG. 9). When rotating member (14) moves the rotation is tracked by the projection (13) which guides inside the guiding slot (10) of the guiding body (8) and it travels straight inside the guiding body (8). When the projection (13) on the rotating member (14) reaches the pivot point (19) the pin member (16) which is inside the slot (11) pushes the rotating member (14) to rotate about its axis (AR). Then the rotating member (14) gets to a locked position (ref. FIG. 5, FIG. 8 and FIG. 10). When the rotating member (14) rotates, the pin member (16) gets release from the slot (11) and drawer (7) moves freely out of furniture body (1).

The angular slot (11) on the rotating member (14) urges the rotating member (14) to rotate when the pin member (16) moves in a straight line and fixed axis with respect to the guiding body (8). The slot (11) on the rotating member (14) is formed on the outer surface at an angle which determines the angle of rotation of the rotating member (14) about its axis (AR). When the rotating member (14) is in rotated condition the angle of the projection (13) from before rotation to the after rotation results the release of the pin member from the slot.

A flap (12) is provided on front edge of the rotating member (14). When the rotating member (14) gets unlocked from the pivot point (19) before the pin member (16) enters in the slot (11) of the rotating member (14) it travels beyond the initial position and rests against the end stop (20). The initial position is when the drawer (7) is in fully inserted position and the pin member (16) inside the slot (11) of the rotating member (14). At this position when the drawer (7) is pulled out of the furniture body (1) the pin member (16) which is behind the flap (12) pulls out the rotating member (14) and the projection (13) on the rotating member (14) reaches the pivot point (19) and rotates. Then the pin member (16) releases from the flap (12) of the rotating member (14) and moves out freely. During the next closing operation the pin member (16) engages inside the slot (12) of the rotating member (14) and the device operates normally.

What is claimed is:

1. A drawer closing device comprising:

an elongate hollow right cylindrical housing having first and second ends;

a first slot extending from the first end of said hollow cylindrical housing to the second end;

a second slot being L-shaped with a leg of the second slot being adjacent and substantially parallel to the first slot;

a cylindrical member telescopically attached within said hollow cylindrical housing and rotatable therein;

a projection on the cylindrical member extending out of the second slot of the hollow cylindrical housing;

an angled groove provided on the cylindrical member to receive a pin attached to a guide rail of a drawer; and a resilient means attached to the second end of the hollow cylindrical housing and to the cylindrical member thereby pulling the cylindrical member to the second end;

wherein when the drawer is moved to an open position, the pin pulls the cylindrical member and the attached resilient means along the first slot towards an angled section, which in effect rotates the cylindrical member and locks it in place, and wherein when said drawer is moved to a closed position, the pin on the guide rail is pushed in, thus engaging with the first slot which rotates the cylindrical member and releases the projection of the cylindrical member so that the resilient means pulls the drawer to the closed position.

2. The drawer closing device as claimed in claim 1 wherein the resilient means is a helical spring.

* * * * *